US007614358B2

(12) United States Patent
Duer

(10) Patent No.: US 7,614,358 B2
(45) Date of Patent: Nov. 10, 2009

(54) METHOD AND DEVICE FOR RECORDING PERIODIC MEDICINAL DOSAGES

(76) Inventor: Lisa Annette Duer, 267 Hiawassee Dr., Woodstock, GA (US) 30188

( * ) Notice: Subject to any disclaimer, the term of this patent is extended or adjusted under 35 U.S.C. 154(b) by 0 days.

(21) Appl. No.: 11/852,307

(22) Filed: Sep. 9, 2007

(65) Prior Publication Data

US 2009/0064920 A1 Mar. 12, 2009

(51) Int. Cl.
*G09F 9/00* (2006.01)
*A61J 7/04* (2006.01)

(52) U.S. Cl. ..... 116/324; 116/283; 116/225; 40/488; 40/491; 206/459.1

(58) Field of Classification Search ..... 116/205, 116/225, 281, 283, 306, 321, 323, 324, DIG. 17; 40/486, 488–491, 508; 235/1 B, 123; 206/459.1, 206/459.5

See application file for complete search history.

(56) References Cited

U.S. PATENT DOCUMENTS 3,485,204 A * 12/1969 Christman ..... 116/324
3,675,620 A 7/1972 Baustin
3,913,249 A * 10/1975 Kaslow ..... 40/488
3,996,879 A 12/1976 Walton
4,148,273 A 4/1979 Hollingsworth
4,189,143 A * 2/1980 Van Auken et al. ..... 116/222
4,752,087 A 6/1988 Weisback
5,011,032 A * 4/1991 Rollman ..... 215/230
5,257,595 A * 11/1993 Cassidy, Jr. ..... 116/321
5,271,353 A 12/1993 Besthorne
5,433,324 A 7/1995 Leonard
5,662,224 A 9/1997 Nogues
5,694,882 A 12/1997 Marshall
5,899,335 A 5/1999 Boyer
5,975,010 A 11/1999 Marshall
5,979,698 A 11/1999 Deal
6,003,467 A 12/1999 Shelton-Ferrell
6,152,067 A 11/2000 Mathison
6,227,371 B1 * 5/2001 Song ..... 206/534
6,279,759 B1 8/2001 Weisbach
6,796,267 B2 9/2004 DuBarry
7,000,791 B2 2/2006 Miller
7,017,513 B2 3/2006 Glewercer
7,017,762 B2 3/2006 Shane
2008/0168940 A1 * 7/2008 Duer et al. ..... 116/324

* cited by examiner

*Primary Examiner*—Amy Cohen Johnson
(74) *Attorney, Agent, or Firm*—George R. Reardon

(57) ABSTRACT

A dosage reminder device is disclosed. The device is comprised of a front plate, a set of slides inserted into the front plate and a back plate connected to the front plate. Each slide indicates a first position for a dosage not taken, a second position to indicate a dosage taken, or to a third position to indicate no dosage. The rear of the back plate has a removable adhesive cover that once removed, facilitates adhering the dosage reminder device to a medicine vial.

14 Claims, 5 Drawing Sheets

METHOD AND DEVICE FOR RECORDING PERIODIC MEDICINAL DOSAGES

FIELD OF THE INVENTION

The technology disclosed herein relates generally to record keeping devices, and in particular, to a device and method for recording periodic utilization of product dosages.

BACKGROUND OF THE INVENTION

A major problem that physicians face when they prescribe a medication for a patient is the possibility that of a patient failing to take his/her medication properly, e.g. the patient may take or use the medication too frequently, not enough, or completely forget to take the medication. Pharmacists normally instruct patients on the proper way to take their medications, but often the patient will forget the directions or not understand them adequately. Some patients forget whether they took their medication as prescribed or at the prescribed times. This problem exists for all forms of medication, including pills capsules, tablets, liquids, and other solids. The problem also applies to veterinary medication prescribed for treatment of animals.

Taking medication improperly can lead to a variety of difficulties. Over-medication can result in toxicity or unwanted side effects while under-medication can result in inadequate treatment of the condition for which the medicine was prescribed. In either situation, the consequences may be serious and may even result in death.

One attempt to monitor a patient's medication has involved the use of medication boxes having individual compartments for the days of the week, with the more elaborate boxes having multiple dose compartments for each day for up to four times a day dosing. While such boxes are indicative of whether a dose for a particular day or dosing interval has been taken, they are also inconvenient to the patient since they are often bulky and must be carried around separately from the patient's medication. Also, the patient must remember to dole out the doses of medication into the appropriate boxes each week prior to the time that the dose must be taken.

Another means used to keep track of medication is an alarm device which alerts the patient as to when the next dose of medication is due. Some of these methods include the use of specific medication alarms, beepers, and watch alarms. The disadvantages of these devices include the fact that the patient may forget to set the alarm or the device may fail to function due to dead batteries, etc. Further, these types of devices do not work well for patients who have difficulty hearing as is often the case with older patients, and may also be difficult to hear if the patient is in a noisy area.

Another method of monitoring medication includes a recording device comprising a container for holding prescription bottles having an indicia area comprising a grid on the outside of the container, with the days of the week on one axis of the grid and the dose and times on the opposite axis, for keeping a record of the times at which medicinal dosages are taken using buttons or markers. This method, however, is also disadvantageous since the device is bulky for the patient to carry around and the patient must further separately carry the marking devices to place on the recording grid.

Other approaches directed to this problem include a variety of reminders and organizers. Reminders might include a beeper that goes off as a reminder to take a pill. This does not answer the question "did I take my pill?" if that question is asked later in the day. There are services that will call and remind a person to take his/her medicine. If the person called gets distracted immediately after the phone call, or does not answer the phone call the question "did I take my pill?" is asked later in the day.

There are also electronic pill organizers requiring removing pills from labeled bottles and placing those pills into to days of the week slots and waiting for a beep as notification to take a pill. There are also manual pill organizers, e.g. large pill boxes divided into days, weeks or even months, in which a user removes his/her medicine from the labeled bottle and place the pills inside. There are several dangerous in using pill organizers. First, it is not recommended by the Institute for Safe Medical Practices and many other organizations to remove any medication from the federally mandated bottle. Any literature educating on safe medication practices strongly advises this for many reasons such as not having pertinent information in case of emergency and the chances the consumer becomes confused on what pill is to be taken if many are involved. Second, not only is it dangerous in emergency situations not to have label information, but it may also be illegal when traveling.

In addition to these approaches described above related art that addresses these and other problems includes the following patents.

U.S. Pat. No. 3,675,620, issued to Baustin, on Jul. 11, 1972 discloses a means for keeping a record of the times at which medicinal dosages are taken in which indicia to record such dosage are arranged in columns and rows opposite the times at which the dosages are to be taken.

U.S. Pat. No. 3,996,879, issued to Walton, on Dec. 14, 1976 discloses a reminder device having a band or collar which fits around a container and displays notations such as days or dates. A display unit with windows is mounted on the band or collar, and the display unit has a spring loaded and movable slide element to selectively cover a window and the notation associated therewith.

U.S. Pat. No. 4,148,273, issued to Hollingsworth et al., on Apr. 10, 1979, discloses a device is described whereby persons required to take one or more doses of a plurality of medicines, over a span of hours and days can keep track of times the dosages should be taken, by means of an apparatus which comprises a thin sheet member having an array of apertures arranged in a multiplicity of mutually perpendicular rows, a plurality of removable color-coded pegs conveniently rounded to be rotatably secured in the holes, arrangement of said holes being indicative of the time of day on one axis and indicative of the medicine to be taken and the dosage on the second axis. Thus, where a person is required, for reasons of health, to take a variety of medicines at differing times of the day or night, then it is a simple matter to program the subject invention whereby the medicine, the dosage and the time are readily and conveniently known.

U.S. Pat. No. 4,752,087, issued to Weisbach, on Jun. 21, 1988 discloses a medication recordkeeping device comprised of a label or sheet with a plurality of characters identifying at least one subject upon which a friably removable mask covering obscures each of the characters. The label or sheet is adapted to be fixedly applied to a medication containing vessel wherein each time an individual unit of medication is consumed, the friable removable mask is removed from a character in order that the underlying subject will be exposed so that a visual record will be kept of the medication consumed. The characters may be dates, numerals or dosage amounts corresponding to a patient's needs or the particular requirements of a medication.

U.S. Pat. No. 5,271,353, issued to Besthorne, on Dec. 21, 1993 discloses a medicine reminder device for a medicine container is provided and consists of a mechanism for removably attaching a housing having a clock face thereon to the medicine container. Hour and minute hands are pivotally mounted to the clock face so that a person can manually move the hour and minute hands to indicate the time medicine must be taken from the medicine container.

U.S. Pat. No. 5,433,324, issued to Joe H. Leonard, on Jul. 18, 1995 discloses a medicine reminder device for reminding an individual taking medication of the time the next dosage should be taken. The medicine reminder device includes a base structure and a time indicator. In the preferred embodiment, the base structure includes a foundation, a cylindrical support which extends upward from the foundation, and an annular lip which extends outward from the cylindrical support. The foundation has a reference mark imprinted thereon. In the preferred embodiment, the time indicator is a ring assembly which rotates around the cylindrical support. The ring assembly defines an annular groove which receives the annular lip to secure the ring assembly to the base structure. The ring assembly has sequential time indicia imprinted thereon. To use the medicine reminder, the medicine bottle of choice is placed inside the cylindrical support, and the ring assembly is rotated such that the selected time from the sequential time indicia is aligned with the reference marker to indicate the time of day that a dose of medicine has been or is to be taken.

U.S. Pat. No. 5,662,224, issued to Nelson E. Nogues, on Sep. 2, 1997 discloses an improvement for containers for medicaments that have to be ingested or applied periodically during the day or night and these containers include a neck connecting the body of a container. A ring with markings is snugly mounted to the neck so that it can be selectively positioned to make one of the markings coincide with one of two reference marking members. One of the two reference marking members is selectively covered with one pad member. The pad member is mounted to the reference marking assembly and it is foldable so that a user can selectively cover one of the reference marking members.

U.S. Pat. No. 5,694,882, issued to Forrest A. Marshall, on Dec. 9, 1997 discloses indicators and methods of indicating. Intended primarily for use with medicine containers, the devices typically indicate the number of doses of medication ingested or remaining to be taken by a patient during a particular period. These devices additionally provide tactile assistance to patients in appropriately repositioning the indicator arms and, when used correctly, may reduce the possibility of patient overdose by restricting improper attempts to advance the indicator arm.

U.S. Pat. No. 5,899,335, issued to Mildred E. Boyer et al., on May 4, 1999 discloses a container for medications, written instructions and other materials for an individual whose cognitive powers may be diminished and who must take several medications or doses at different times of a day. The container takes the annular array form of a clock face with hourly positions having either or both visual and/or Braille indicia. Each hourly position has a separate lid-covered compartment for placement therein of medications or instructions to be taken within designated hours. The containers are provided in pairs, one being designated for ante meridiem hours and the other for post meridiem hours. They may be alternately arranged coaxially with a clock having either an hour hand or a blocking shutter, the latter of which insures that only the lid of a given compartment is accessible at the designated time for taking a specific medication. Pairs of containers sufficient for a week's medications can be organized, filled and stacked for successive use. The system enables monitoring by a care giver to assure that medications have been taken.

U.S. Pat. No. 5,975,010, issued to Forrest A. Marshall, on Nov. 2, 1999 discloses indicators and methods of indicating. Intended primarily for use with medicine containers, the devices typically indicate the number of doses of medication ingested or remaining to be taken by a patient during a particular period. These devices additionally provide tactile assistance to patients in appropriately repositioning the indicator arms and, when used correctly, may reduce the possibility of patient overdose by restricting improper attempts to advance the indicator arm.

U.S. Pat. No. 5,979,698, issued to Deal, on Nov. 9, 1999 discloses a medicinal recording device is provided which is placed directly upon a patient's medication container. The device consists of at least one strip having a plurality of indicia on raised or recessed detents. The indicia correspond to days and dosages. The patient slides a tab attached to the strip along the strip to the marked button corresponding to the day the medication is taken and/or the number of the dose taken. The tab engages the strip adjacent the selected indicia to releasably lock the tab in position and to prevent unintended sliding of the tab.

U.S. Pat. No. 6,003,467, issued to Paige Shelton-Ferrell, et al., on Dec. 21, 1999 discloses a medication dosage indicator having two portions, a body portion and a cap portion. The body portion includes a circular top wall and a plurality of raised indicator tabs spaced apart in a circular fashion that have indicia corresponding to the day of the week or other unit of time. The cap portion includes a circular upper wall with a plurality of apertures sized and spaced apart to fit in a mating relationship with the indicator tabs.

U.S. Pat. No. 6,152,067, issued to Mathison, on Nov. 28, 2000 discloses a medication dosage reminder device includes a cruciform hub that attaches to a medication container and an annular dial that is pinned between the hub and the container but is otherwise free to rotate about the hub. The dial includes time of day indicia and the hub includes a co-operating pointer for selecting the time of day so indicated. A patient can rotate the dial about the hub to indicate the time at which the last dose of medication was taken or the time at which the next dose of medication is due.

U.S. Pat. No. 6,279,759, issued to Weisbach, on Aug. 28, 2001 discloses a medication recordkeeping device comprised of a label or sheet with a plurality of characters identifying at least one subject upon which a friably removable mask covering obscures each of the characters. The label or sheet is adapted to be fixedly applied to a medication containing vessel wherein each time an individual unit of medication is consumed, the friable removable mask is removed from a character in order that the underlying subject will be exposed so that a visual record will be kept of the medication consumed. The characters may be dates, numerals or dosage amounts corresponding to a patient's needs or the particular requirements of the medication. The label or sheet preferably also includes an area for recording important information such as a patient's name or medical history. A bar code may be provided for recording relevant information. Further, the label or sheet can be inserted into a housing apparatus which attaches a medicine container thereto.

U.S. Pat. No. 6,796,267, issued to DuBarry, on Sep. 28, 2004 discloses a reusable device that provides tracking of task performance by multiple independently movable arms that lock into position provides a clear visual cue as to use and eliminates potential unintentional movement of the arms. The arms can be pivotally or slidably mounted to a base. The pivotal mounting can include a mechanical hinge or a flexible material providing a living hinge. The lock releasably secures the arms independently in two or more positions indicating to the user the performance of a task such as taking a medication one or more times during a day or other period of time. At the end of the cycle of use, usually one week, the arms may be reset and the device used again. The device may be small enough and include a fastener to mount it to a pill bottle, specific to what is in need of reminding the user. Another version the device rests on a table, preferably in an area that is frequented by the user to visually remind the user to take the medication or performing another activity.

U.S. Pat. No. 7,000,791, issued to Mark H. Miller, on Feb. 21, 2006 discloses a closure for medicine vials, comprising a cap and a rotatable detented indicator arranged to indicate the last pill or medicine dose taken. The indicator may be transparent with numbers that are rendered visible by contrast with the cap color. The indicator may use 12 detented positions, a number evenly divisible by the common prescription quantities of 2, 3, 4, and 6 per day.

U.S. Pat. No. 7,017,513, issued to Glewercer, on Mar. 28, 2006 discloses a dosage reminder device and medication carton includes an indicator/support formed from the carton's flat exterior wall retentively engaging a rotateable ring. The ring includes dosage time period indicia establishing a dosage schedule and the indicator includes a co-operating next dose pointer for selecting the next dosage time period so indicated. A patient can rotate the ring to align the next scheduled dosage time period with the indicator pointer. The indicator pointer and the scheduled dosage time period form a reminder indicating when the next dose is due or when the last dose was taken.

U.S. Pat. No. 7,017,762, issued to Terry Shane, on Mar. 28, 2006 discloses a cap or closure for medication bottles, containers or vials has a base with a peripheral wall to define a recess. A cover is notably located in the recess below the rim of the peripheral wall. The cover has a marker that is selectively aligned with indicia indicating dosage intervals. A one-way mechanism inhibits rotation of the cover relative to the base in one direction, providing the consumer with a simple mechanical device that acts as a reminder of when the next does in a course of medication is due or when the last dose was taken. The closure permits a single cap to serve the needs of different medication frequencies while being inexpensive enough to be included with each container provided by a pharmacy or manufacturer of non-prescription medications or homeopathic products.

While these patents and other previous methods have attempted to solve the problems that they addressed, none have utilized or disclosed an economical, easy to install and use assurance dosage strip capable of being attached to the side of a medicine vial or bottle and directed to both sighted, impaired vision and blind users, as does embodiments of the technology disclosed herein.

Therefore, a need exists for an assurance dosage strip with these attributes and functionalities. The assurance dosage strip according to embodiments of the invention substantially departs from the conventional concepts and designs of the prior art. It can be appreciated that there exists a continuing need for a new and improved assurance dosage strip which can be used commercially. In this regard, the technology disclosed herein substantially fulfills these objectives.

The foregoing patent and other information reflect the state of the art of which the inventor is aware and are tendered with a view toward discharging the inventor's acknowledged duty of candor in disclosing information that may be pertinent to the patentability of the technology disclosed herein. It is respectfully stipulated, however, that the foregoing patent and other information do not teach or render obvious, singly or when considered in combination, the inventor's claimed invention.

BRIEF SUMMARY OF THE INVENTION

In general, the technology disclosed herein features three elements: a front plate, a set of slides and a back plate. The set of slides are capable of being inserted into corresponding holes in the rear of the front plate and the front of the back plate is capable of being connected to the rear of the front plate, with the set of slides inserted into the corresponding holes. The set of slides is capable of sliding within this assembly to indicate a first position for a dosage not taken to a second position to indicate a dosage taken, or to a third position to indicate no dosage. The rear of the back plate may have an adhesive to facilitate adhering to a target container. The front of the front plate may have visual and/or tactile indicators corresponding to each slide to indicate $1^{st}$ dosage, $2^{nd}$ dosage, $3^{rd}$ dosage, $4^{th}$ dosage, etc. These visual and/or tactile indicators may be in Braille, raised bumps in non-Braille, the numbers 1, 2, 3, 4, B-L-S-N for Breakfast, Lunch, Supper, Night, or other designations indicating when a dosage should be taken.

The assurance dosage strip is dimensioned to be placed on a container, e.g. medicine vial, vitamin bottle, etc., to facilitate the proper taking of the contents of the container.

In an exemplary embodiment the technology disclosed herein is a thin plastic strip consisting of four plastic slide buttons and an adhesive backing. The assembly is approximately 1.875" long by 0.625" wide with a slight radius. The color is a white body with light blue slides, but other colors may be used. A logo may be embossed on the front on the right side. Braille numbers 1 through 4 may be embossed on the left side. Removing a protective covering on the adhesive back, the assembly may be placed on any medicine, vitamin, supplement, pet medicine, etc. bottle or vial.

One aspect of the technology disclosed herein is that it facilitates the answering of the question "did I take my medicine?" by a medicine user.

Another aspect of the technology disclosed herein is that a medicine user simply aligns all indicator slides to the left, then as each dose is taken the user moves one slide to the right.

Another aspect of the technology disclosed herein is that medication is not transferred to a daily organizer; all prescription label information stays with the medicine, which is especially important when traveling or in emergency situations. Keeping the medicine in its original container is also important due to most bottles being designed to filter UV rays.

Another aspect of the technology disclosed herein is that it may serve as a habit forming tool in the aid of taking medicine.

Another aspect of the technology disclosed herein is that it can be made economically.

Another aspect of the technology disclosed herein is that it may be made from readily available materials.

Other objects, advantages and capabilities of the technology disclosed herein are apparent from the following description taken in conjunction with the accompanying drawings showing the preferred embodiment of the invention.

BRIEF DESCRIPTION OF THE SEVERAL VIEWS OF THE DRAWINGS

The technology described herein, together with further advantages thereof, may best be understood by reference to the following description of the simplest form of the invention, taken in conjunction with the accompanying drawings in which.

DETAILED DESCRIPTION OF THE INVENTION

The technology disclosed herein will now be described in detail with reference to at least one preferred embodiment thereof as illustrated in the accompanying drawings. In the following description, numerous specific details are set forth in order to provide a thorough understanding of the technology disclosed herein. It will be apparent, however, to one skilled in the art, that the technology disclosed herein may be practiced without some or all of these specific details. In other instances, well known operations have not been described in detail so not to unnecessarily obscure the technology disclosed herein.

Figure 1:
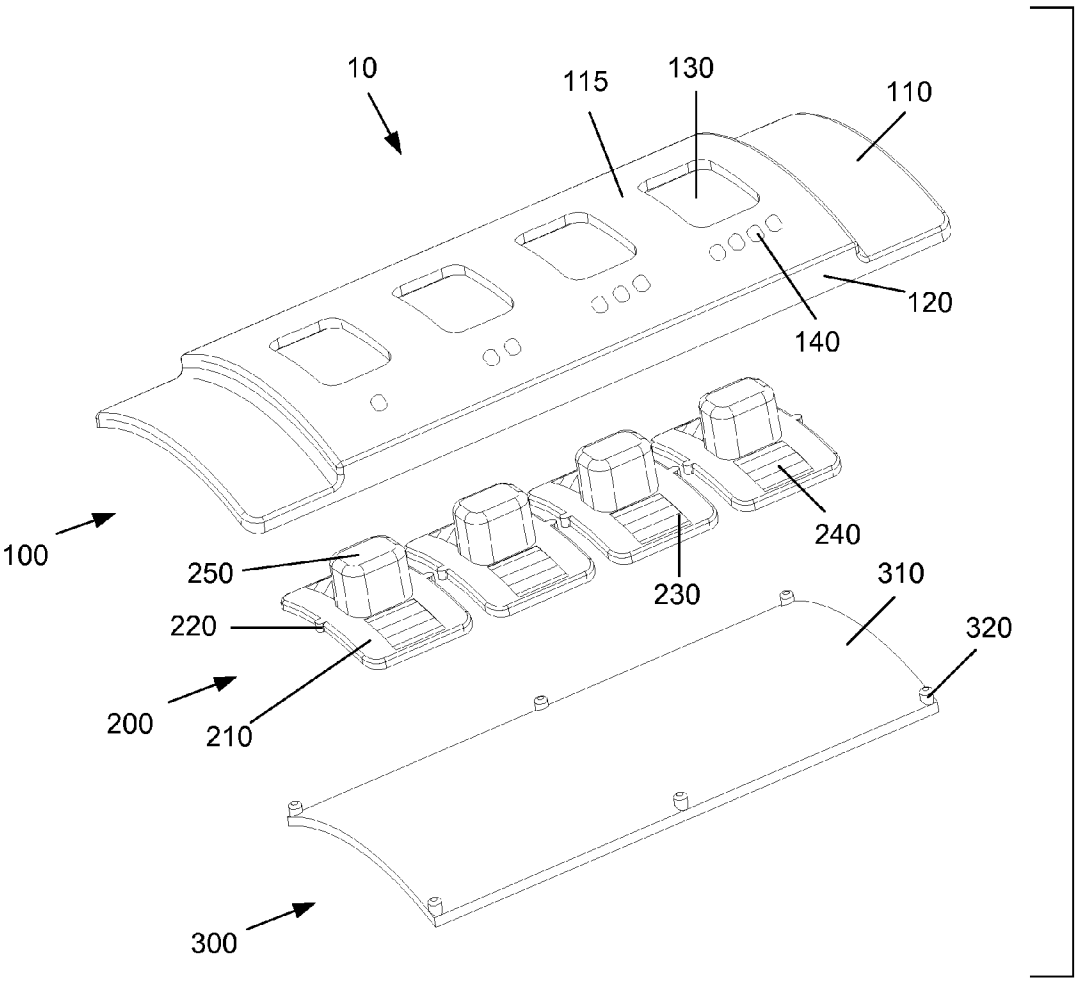
FIG. 1 illustrates an exploded top view, according to an embodiment of the technology disclosed herein.
Figure 2:
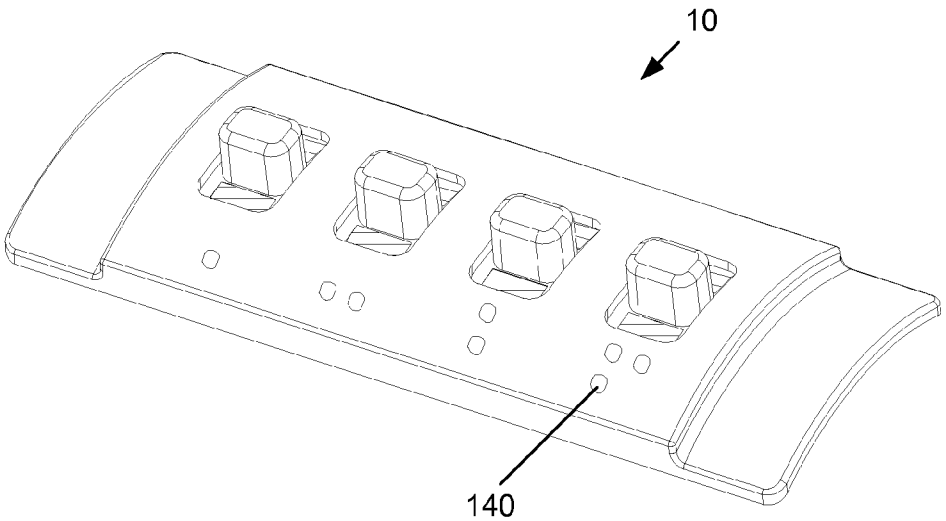
FIG. 2 illustrates an elevational view, according to an embodiment of the technology disclosed herein.
Figure 3:
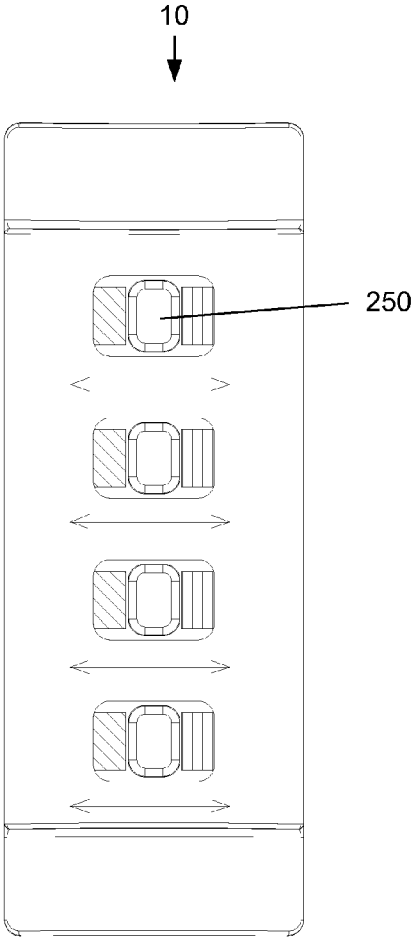
FIG. 3 illustrates a front plan view illustrating slide buttons in a neutral position, according to an embodiment of the technology disclosed herein.
Figure 4:
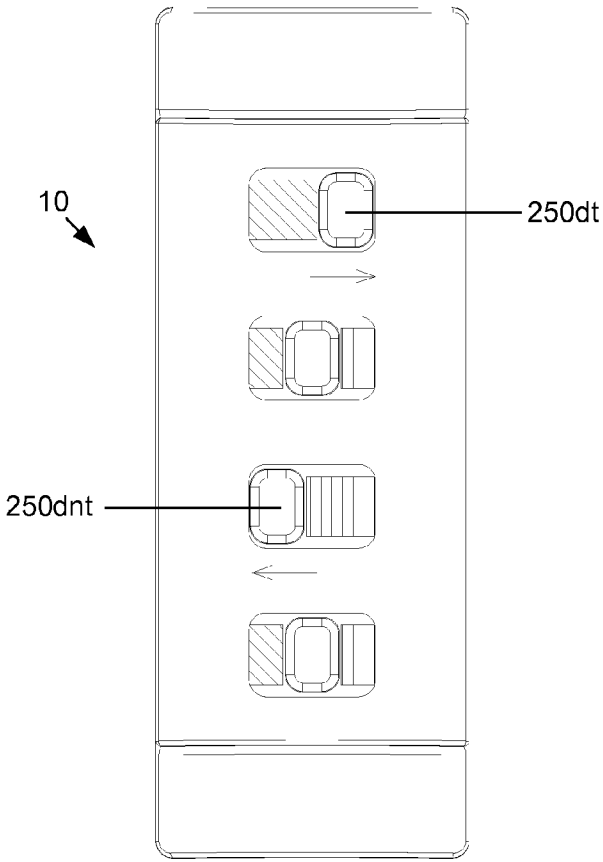
FIG. 4 illustrates a front plan view, illustrating one slide button in a dosage taken, another slide button in a dosage not taken position, according to an embodiment of the technology disclosed herein.
Figure 5:
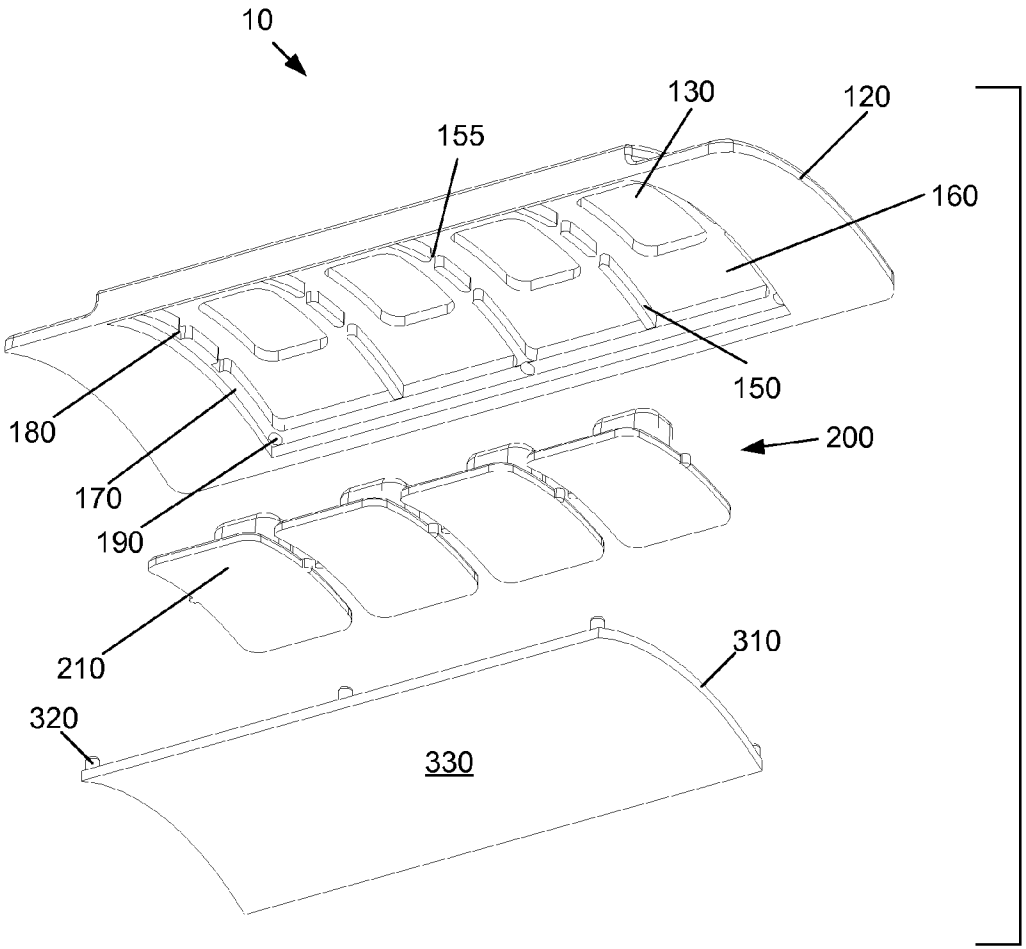
FIG. 5 illustrates an exploded bottom view, according to an embodiment of the technology disclosed herein.

Referring to the drawings, FIGS. 1-5, wherein like reference numerals designate corresponding parts throughout the several figures, reference is made first to FIG. 1 and FIG. 5, which illustrate an assurance dosage strip 10 comprising three elements, a front plate 100, a plurality of a slide assembly 200 and a back plate 300.

The front plate 100 is comprised of a front plate body 110, a face plate 115, a rib edge 120, a plurality of a finger button hole 130, a slide gate 150, a slide gate cavity 160, a plurality of a key hole 180 and a plurality of a pin hole 190.

Each slide assembly 200 is comprised of a slide base 210, a slide base lock 220, a slide base channel 230, a slide base channel surface 240 and a finger button 250. The slide base channel surface may have one or more distinctive colors to reinforce if a dosage has been taken, e.g. red may show in the "dosage taken" position and green may show in the "dosage not taken" position.

The back plate 300 is comprised of a back plate base 310 having a plurality of a back plate pin 320, dimensioned and positioned to snap fit into corresponding pin hole 190. The back plate 300 is further comprised of back plate adhesive removable cover 330 which may be removed in order to fasten the assurance dosage strip 10 to a corresponding shaped medicine vial or the like.

In an exemplary embodiment, the front plate has a dosage indicator 140 corresponding to each slide assembly 200. The dosage indicator 140 may be in Braille for blind users. The dosage indicator may be a non-Braille tactile indicator, e.g. one protrusion, two protrusions, etc. for sight impaired users who have not learned Braille. The dosage indicator may be a visible indicator, e.g. 1, 2, 3, 4. The dosage indicator may be combinations of Braille, tactile non-Braille, and visible non-tactile indicators.

The foregoing description and drawings comprise illustrative embodiments of the technology disclosed herein. Having thus described exemplary embodiments of the technology disclosed herein, it should be noted by those skilled in the art that the within disclosures are exemplary only, and that various other alternatives, adaptations and modifications may be made within the scope of the technology disclosed herein. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing description and the associated drawings. Although specific terms may be employed herein, they are used in a generic and descriptive sense only and not for purposes of limitation.

I claim:

1. An assurance dosage strip capable of attachment to a medicine vial, comprising:

a front plate having a front plate top side, a front plate bottom side, a front plate left side and a front plate right side;

a plurality of slide assemblies;

and a back plate having a back plate top side, a back plate bottom side, a back plate left side and a back plate right side; and a dosage indicator;

wherein the front plate, the plurality of slide assemblies, the back plate; and the dosage indicator are curved and collectively form an assurance dosage strip for attachment to a medicine vial;

wherein the front plate is further comprised of a front plate body, a face plate, a rib edge, a plurality of a finger button holes a slide gate, a slide gate cavity, a plurality of a key holes and a plurality of a pin holes disposed in the front plate bottom side;

wherein each slide assembly is further comprised of a slide base, a slide base lock, a slide base channel, a slide base channel surface having distinctive coloring, and a finger button, wherein the back plate is further comprised of a back plate base having a plurality of a protrusions disposed on the back plate top side, wherein each protrusion is dimensioned and positioned to snap fit into each corresponding pin hole, wherein the back plate is further comprised of a back plate adhesive removable cover.

2. The assurance dosage strip of claim 1, wherein the plurality of a pin holes is a first pin hole, a second pin hole, a third pin hole, a fourth pin hole, a fifth pin hole and a sixth pin hole;

wherein the plurality of a protrusions is a first protrusion, a second protrusion, a third protrusion, a fourth protrusion, a fifth protrusion and a sixth protrusion;

wherein the first pin hole, the second pin hole, and the third pin hole are positioned along the front plate right side with the second pin hole positioned substantially midway along the front plate right side and substantially equidistant from the first pin hole and the second pin hole;

wherein the fourth pin hole, the fifth pin hole, and the sixth pin hole are positioned along the front plate left side with the fifth pin hole positioned substantially midway along the front plate left side and substantially equidistant from the fourth pin hole and the sixth pin hole;

wherein the first protrusion, the second protrusion, and the third protrusion are positioned along the back plate right side with the second protrusion positioned substantially midway along the back plate right side and substantially equidistant from the first protrusion and the second protrusion;

wherein the fourth protrusion, the fifth protrusion, and the sixth protrusion are positioned along the back plate left side with the fifth protrusion positioned substantially midway along the back plate left side and substantially equidistant from the fourth protrusion and the sixth protrusion.

3. The assurance dosage strip of claim 2, further comprising a dosage indicator corresponding to each slide assembly.

4. The assurance dosage strip of claim 3, wherein the dosage indicator is a tactile indicator.

5. The assurance dosage strip of claim 4, wherein the tactile indicator is a Braille indicator.

6. The assurance dosage strip of claim 3, wherein the dosage indicator is a non-tactile indicator.

7. The assurance dosage strip of claim 3, wherein the dosage indicator is comprised of a tactile indicator combined with a non-tactile indicator.

8. The assurance dosage strip of claim 3, wherein the assurance dosage strip is approximately 1.875" long by 0.625" wide and has a logo disposed on the front plate top side.

9. The assurance dosage strip of claim 1, further comprising a dosage indicator corresponding to each slide assembly.

10. The assurance dosage strip of claim 9, wherein the dosage indicator is a tactile indicator.

11. The assurance dosage strip of claim 10, wherein the tactile indicator is a Braille indicator.

12. The assurance dosage strip of claim 11, wherein the dosage indicator is a non-tactile indicator.

13. The assurance dosage strip of claim 12, wherein the dosage indicator is comprised of a tactile indicator combined with a non-tactile indicator.

14. The assurance dosage strip of claim 13, wherein the assurance dosage strip is approximately 1.875" long by 0.625" wide and has a logo disposed on the front plate top side.

* * * * *